US011268397B2

(12) United States Patent
Franklin et al.

(10) Patent No.: US 11,268,397 B2
(45) Date of Patent: Mar. 8, 2022

(54) FAN BLADE PLATFORM SEAL AND METHOD FOR FORMING SAME

(71) Applicant: United Technologies Corporation, Farmington, CT (US)

(72) Inventors: Jordan J. Franklin, Sarasota, FL (US); Peter Karkos, Old Saybrook, CT (US); David R. Lyders, Glastonbury, CT (US); Chong H. Park, Ivoryton, CT (US); Matthew R. Zsunkan, Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 99 days.

(21) Appl. No.: 16/785,145

(22) Filed: Feb. 7, 2020

(65) Prior Publication Data

US 2021/0246798 A1 Aug. 12, 2021

(51) Int. Cl.
*F01D 11/00* (2006.01)

(52) U.S. Cl.
CPC ..... *F01D 11/008* (2013.01); *F05D 2220/36* (2013.01); *F05D 2230/60* (2013.01); *F05D 2240/55* (2013.01)

(58) Field of Classification Search
CPC ..... F01D 11/006; F01D 11/008; F05D 2240/55–59
See application file for complete search history.

(56) References Cited

U.S. PATENT DOCUMENTS 3,712,757 A * 1/1973 Goodwin ..... F01D 5/28 416/245 R
4,177,013 A * 12/1979 Patterson ..... F01D 5/22 416/193 A
5,193,982 A * 3/1993 Inizan ..... F01D 11/008 416/193 A
5,464,326 A * 11/1995 Knott ..... F01D 11/008 416/193 A
5,890,874 A * 4/1999 Lambert ..... F01D 11/008 416/193 A
6,514,045 B1 * 2/2003 Barton ..... F01D 5/22 416/193 A
7,942,636 B2 * 5/2011 Evans ..... F01D 11/006 416/193 R (Continued)

OTHER PUBLICATIONS

EP search report for EP21155550.3 dated Jun. 24, 2021.

*Primary Examiner* — Topaz L. Elliott
(74) *Attorney, Agent, or Firm* — Getz Balich LLC

(57) ABSTRACT

A fan blade platform seal includes a platform portion including a first side and a second side opposite the first side. The platform portion further includes a flow path surface extending between the first side and the second side and a bonding surface opposite the flow path surface. The fan blade platform seal further includes a first seal portion including a first bonding segment including a first outer surface, mounted to the platform portion on the first side of the platform portion, and a first inner surface opposite the first outer surface. The fan blade platform seal further includes a stiffening portion mounted to the first inner surface. The stiffening portion includes a first bonding layer bonded to the first inner surface and a stiffening layer bonded to the first bonding layer on a first layer side of the stiffening layer.

16 Claims, 8 Drawing Sheets

(56) References Cited

U.S. PATENT DOCUMENTS

| | | | | |
|---|---|---|---|---|
| 7,950,900 | B2 * | 5/2011 | Mulcaire | F01D 11/008 415/208.2 |
| 8,297,931 | B2 * | 10/2012 | Read | F02K 3/06 416/215 |
| 8,827,651 | B2 | 9/2014 | Bottome | |
| 9,017,031 | B2 | 4/2015 | Bottome | |
| 9,017,032 | B2 * | 4/2015 | Mason | F01D 11/008 416/193 A |
| 9,976,426 | B2 | 5/2018 | Turner | |
| 10,557,361 | B1 * | 2/2020 | Karkos | F01D 5/147 |
| 2007/0280830 | A1 * | 12/2007 | Mulcaire | F01D 11/008 416/193 R |
| 2008/0018056 | A1 * | 1/2008 | Evans | F01D 11/006 277/590 |
| 2010/0040472 | A1 * | 2/2010 | Read | F01D 11/008 416/204 R |
| 2010/0129211 | A1 * | 5/2010 | Hart | F01D 25/246 415/209.3 |
| 2012/0244007 | A1 * | 9/2012 | Mason | F04D 29/322 416/235 |
| 2013/0309073 | A1 * | 11/2013 | Brown | F01D 5/3007 415/173.1 |
| 2016/0305439 | A1 | 10/2016 | Alarcon | |
| 2018/0010462 | A1 | 1/2018 | Guivarc'H | |
| 2019/0145268 | A1 * | 5/2019 | Thompson | F01D 5/3007 415/209.4 |

* cited by examiner

FAN BLADE PLATFORM SEAL AND METHOD FOR FORMING SAME

BACKGROUND

1. Technical Field

This disclosure relates generally to fan sections of gas turbine engines, and more particularly to sealing arrangements for fan blades.

2. Background Information

In certain types of gas turbine engines, the fan includes a fan rotor having fan blades with integral platforms located near the roots of the fan blades. In other types of gas turbine engines with more complex fan blade designs, non-integral platforms radially extend from a fan rotor between adjacent fan blades. Because these platforms are non-integral with the fan blades, spaces may be formed between the platforms and the blades. As a result, aerodynamic efficiency may be lost due to these spaces between the platforms and the fan blades. In order to improve aerodynamic efficiency and secondary air flow, these spaces may be sealed.

One option for sealing the space between adjacent fan blades may be the inclusion of a fan blade platform seal mounted to the fan rotor between the adjacent fan blades. The fan blade platform seal may include a platform portion and seal portions mounted to the sides of the platform portion to form seals with the respective adjacent fan blades. However, conventional fan blade platform seals are not robust and may suffer from disbonding or inversion (e.g., rotation of the seal into the engine flow path) of the seal portions during certain conditions of gas turbine engine operation. Damage or loss of the seal portions during gas turbine engine operation may, in turn, lead to reduced performance of the gas turbine engine. Accordingly, what is needed is an improved fan blade platform seal which addresses one or more of the above-noted concerns without adding substantial weight or presenting additional foreign object damage risk.

SUMMARY

It should be understood that any or all of the features or embodiments described herein can be used or combined in any combination with each and every other feature or embodiment described herein unless expressly noted otherwise.

According to an embodiment of the present disclosure, a fan blade platform seal includes a platform portion including a first side and a second side opposite the first side. The platform portion further includes a flow path surface extending between the first side and the second side and a bonding surface opposite the flow path surface. The fan blade platform seal further includes a first seal portion including a first bonding segment including a first outer surface, mounted to the platform portion on the first side of the platform portion, and a first inner surface opposite the first outer surface. The fan blade platform seal further includes a stiffening portion mounted to the first inner surface. The stiffening portion includes a first bonding layer bonded to the first inner surface and a stiffening layer bonded to the first bonding layer on a first layer side of the stiffening layer.

In the alternative or additionally thereto, in the foregoing embodiment, the first seal portion further includes a first sealing flap extending from the first bonding segment to a sealing end. The first sealing flap projects away from the platform portion. The first sealing flap includes a first seal inner surface extending from the first inner surface of the first bonding segment.

In the alternative or additionally thereto, in the foregoing embodiment, the stiffening portion is additionally mounted to the first seal inner surface.

In the alternative or additionally thereto, in the foregoing embodiment, the stiffening portion is additionally mounted to the bonding surface of the platform portion.

In the alternative or additionally thereto, in the foregoing embodiment, the fan blade platform seal further includes a second seal portion including a second bonding segment including a second outer surface, mounted to the platform portion on the second side of the platform portion, and a second inner surface opposite the second outer surface.

In the alternative or additionally thereto, in the foregoing embodiment, the stiffening portion is additionally mounted to the second inner surface.

In the alternative or additionally thereto, in the foregoing embodiment, the stiffening portion is additionally mounted to the bonding surface of the platform portion.

In the alternative or additionally thereto, in the foregoing embodiment, the stiffening portion further includes a second bonding layer bonded to a second layer side of the stiffening layer opposite the first layer side.

In the alternative or additionally thereto, in the foregoing embodiment, the stiffening layer includes a reinforcement fabric.

In the alternative or additionally thereto, in the foregoing embodiment, the first seal portion includes a seal body and a fabric layer covering at least a portion of the seal body.

In the alternative or additionally thereto, in the foregoing embodiment, the platform portion further includes a forward end and an aft end and each of the first seal portion and the second seal portion extend from the forward end to the aft end.

In the alternative or additionally thereto, in the foregoing embodiment, the stiffening layer extends from the forward end to the aft end.

According to another embodiment of the present disclosure, a method for forming a fan blade platform seal is provided. The method includes providing a platform portion including a first side and a second side opposite the first side. The platform portion further includes a flow path surface extending between the first side and the second side and a bonding surface opposite the flow path surface. The method further includes mounting a first seal portion to the first side of the platform portion. The first seal portion includes a first bonding segment including a first inner surface opposite the platform portion. The method further includes applying a stiffening portion to the first inner surface by bonding a stiffening layer to the first inner surface with a first bonding layer.

In the alternative or additionally thereto, in the foregoing embodiment, the first seal portion further includes a first sealing flap extending from the first bonding segment to a sealing end. The method further includes applying the stiffening portion to a first seal inner surface of the first sealing flap by bonding the stiffening layer to the first seal inner surface with the bonding layer.

In the alternative or additionally thereto, in the foregoing embodiment, the method further includes applying the stiffening portion to the bonding surface of the platform portion by bonding the stiffening layer to the bonding surface with the bonding layer.

In the alternative or additionally thereto, in the foregoing embodiment, the bonding layer includes an adhesive.

In the alternative or additionally thereto, in the foregoing embodiment, the method further includes mounting a second seal portion to the second side of the platform portion. The second seal portion includes a second bonding segment including a second inner surface opposite the platform portion. The method further includes applying the stiffening portion to the second inner surface by bonding the stiffening layer to the second inner surface with the first bonding layer. The stiffening portion extends from the first seal portion to the second seal portion.

According to another embodiment of the present disclosure, a gas turbine engine includes a fan configured to rotate about a longitudinal centerline of the gas turbine engine. The fan includes a plurality of fan blades extending radially outward from and circumferentially spaced about a fan rotor. The gas turbine engine further includes a fan blade platform seal circumferentially disposed between circumferentially adjacent fan blades of the plurality of fan blades. The fan blade platform seal includes a platform portion including a first side and a second side opposite the first side. The platform portion further includes a flow path surface extending between the first side and the second side and a bonding surface opposite the flow path surface. The fan blade platform seal further includes a first seal portion including a first bonding segment including a first outer surface, mounted to the bonding surface on the first side of the platform portion, and a first inner surface opposite the first outer surface. The fan blade platform seal further includes a second seal portion including a second bonding segment including a second outer surface, mounted to the bonding surface on the second side of the platform portion, and a second inner surface opposite the second outer surface. The fan blade platform seal further includes a stiffening portion mounted to the first inner surface and the second inner surface. The stiffening portion includes a first bonding layer bonded to the first inner surface and the second inner surface, a stiffening layer bonded to the first bonding layer on a first layer side of the stiffening layer, and a second bonding layer bonded to a second layer side of the stiffening layer opposite the first layer side.

In the alternative or additionally thereto, in the foregoing embodiment, the first seal portion further includes a first sealing flap extending from the first bonding segment to a first sealing end and the second seal portion further includes a second sealing flap extending from the second bonding segment to a second sealing end. The stiffening portion is additionally mounted to the first sealing flap and the second sealing flap.

In the alternative or additionally thereto, in the foregoing embodiment, the stiffening portion is additionally mounted to the bonding surface of the platform portion.

The present disclosure, and all its aspects, embodiments and advantages associated therewith will become more readily apparent in view of the detailed description provided below, including the accompanying drawings.

DETAILED DESCRIPTION

Figure 1:
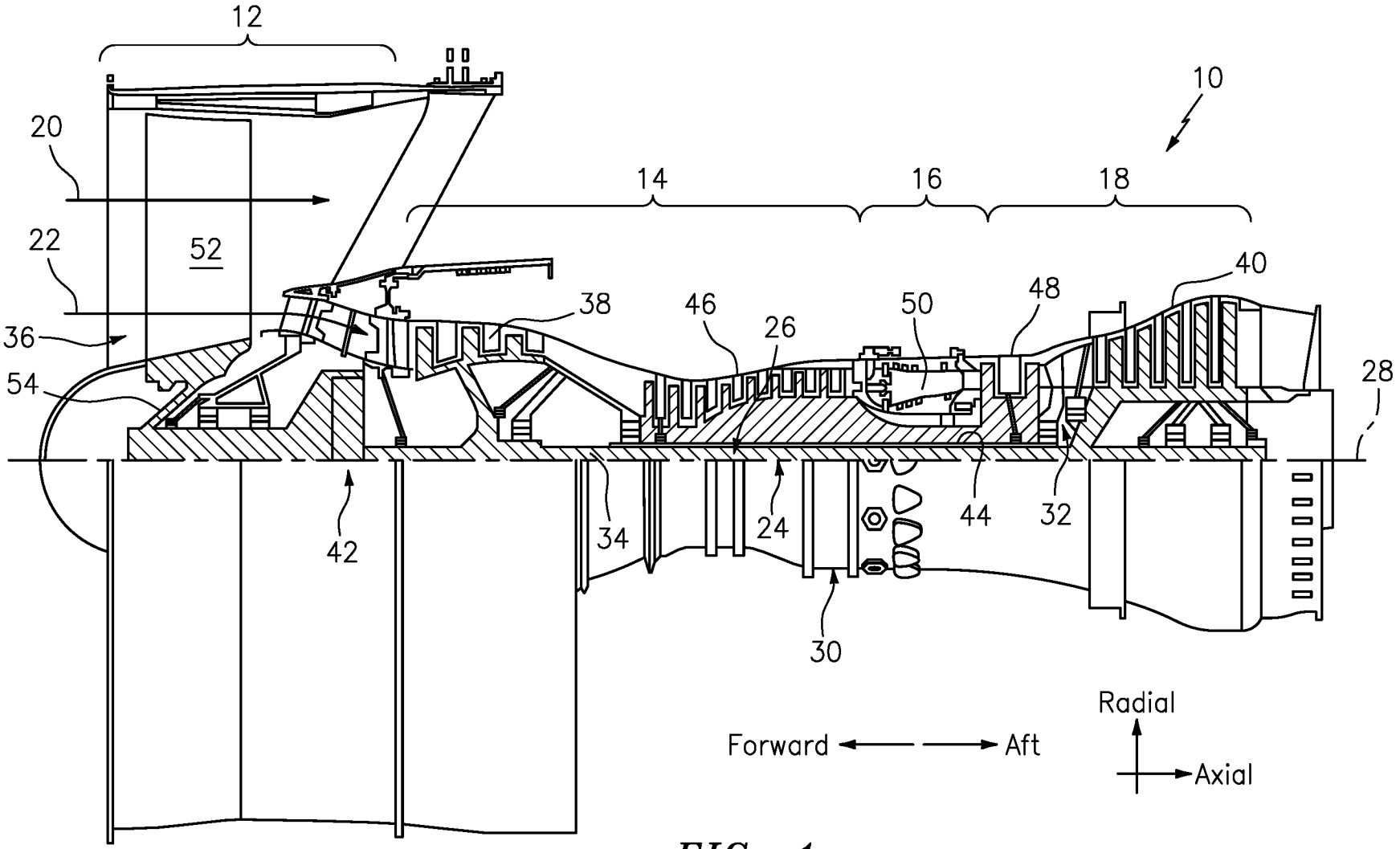
FIG. 1 illustrates a side cross-sectional view of a gas turbine engine in accordance with one or more embodiments of the present disclosure.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Referring to FIG. 1, an exemplary gas turbine engine 10 is schematically illustrated. The gas turbine engine 10 is disclosed herein as a two-spool turbofan engine that generally includes a fan section 12, a compressor section 14, a combustor section 16, and a turbine section 18. The fan section 12 drives air along a bypass flow path 20 while the compressor section 14 drives air along a core flow path 22 for compression and communication into the combustor section 16 and then expansion through the turbine section 18. Although depicted as a turbofan gas turbine engine in the disclosed non-limiting embodiments, it should be understood that the concepts described herein are not limited to use with turbofans as the teachings may be applied to other types of turbine engines including those with three-spool architectures.

The gas turbine engine 10 generally includes a low-pressure spool 24 and a high-pressure spool 26 mounted for rotation about a longitudinal centerline 28 of the gas turbine engine 10 relative to an engine static structure 30 via one or more bearing systems 32. It should be understood that various bearing systems 32 at various locations may alternatively or additionally be provided.

The low-pressure spool 24 generally includes a first shaft 34 that interconnects a fan 36, a low-pressure compressor 38, and a low-pressure turbine 40. The first shaft 34 is connected to the fan 36 through a gear assembly of a fan drive gear system 42 to drive the fan 36 at a lower speed than the low-pressure spool 24. The high-pressure spool 26 generally includes a second shaft 44 that interconnects a high-pressure compressor 46 and a high-pressure turbine 48. It is to be understood that "low pressure" and "high pressure" or variations thereof as used herein are relative terms indicating that the high pressure is greater than the low pressure. An annular combustor 50 is disposed between the high-pressure compressor 46 and the high-pressure turbine 48 along the longitudinal centerline 28. The first shaft 34 and the second shaft 44 are concentric and rotate via the one or more bearing systems 32 about the longitudinal centerline 28 which is collinear with respective longitudinal centerlines of the first and second shafts 34, 44.

Airflow along the core flow path 22 is compressed by the low-pressure compressor 38, then the high-pressure compressor 46, mixed and burned with fuel in the combustor 50, and then expanded over the high-pressure turbine 48 and the low-pressure turbine 40. The low-pressure turbine 40 and the high-pressure turbine 48 rotationally drive the low-pressure spool 24 and the high-pressure spool 26, respectively, in response to the expansion.

Figure 2:
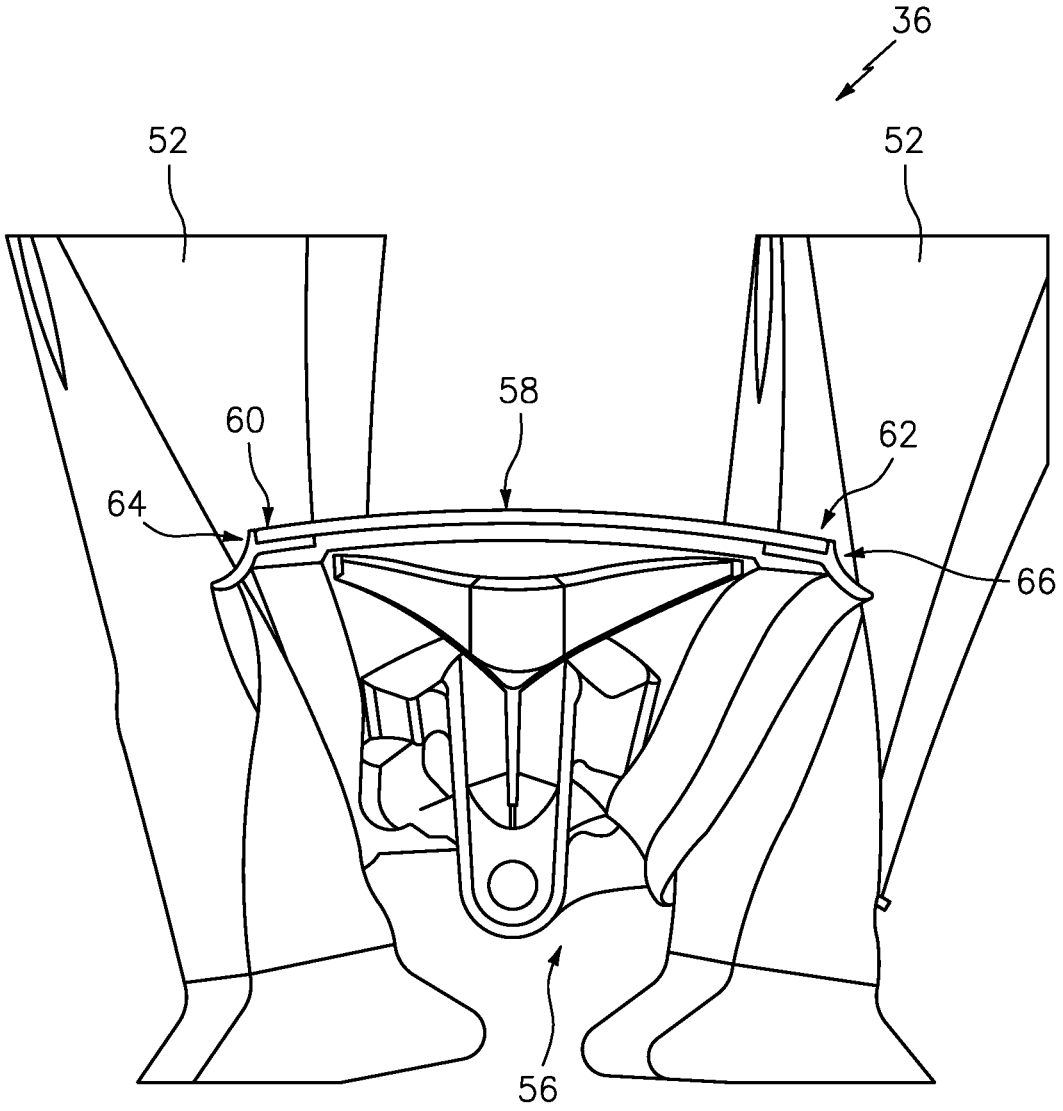
FIG. 2 illustrates a perspective view of an exemplary fan blade platform seal installed in the gas turbine engine of FIG. 1 in accordance with one or more embodiments of the present disclosure.

Referring to FIGS. 1 and 2, the fan 36 includes a plurality of fan blades 52 extending radially outward from and circumferentially spaced about a fan rotor 54. A plurality of fan blade platform seals 56 extend from the fan rotor 54 with each fan blade platform seal 56 disposed between circumferentially adjacent fan blades of the plurality of fan blades 52. The fan blade platform seal 56 includes a platform portion 58 having a first side 60 and a second side 62 opposite the first side 60. The fan blade platform seal 56 further includes a first seal portion 64 mounted to the first side 60 of the platform portion 58 and a second seal portion 66 mounted to the second side 62 of the platform portion 58. The first seal portion 64 is in sealing communication with a first fan blade of the plurality of fan blades 52 while the second seal portion 64 is in sealing communication with a second adjacent fan blade of the plurality of fan blades 52.

Figure 3:
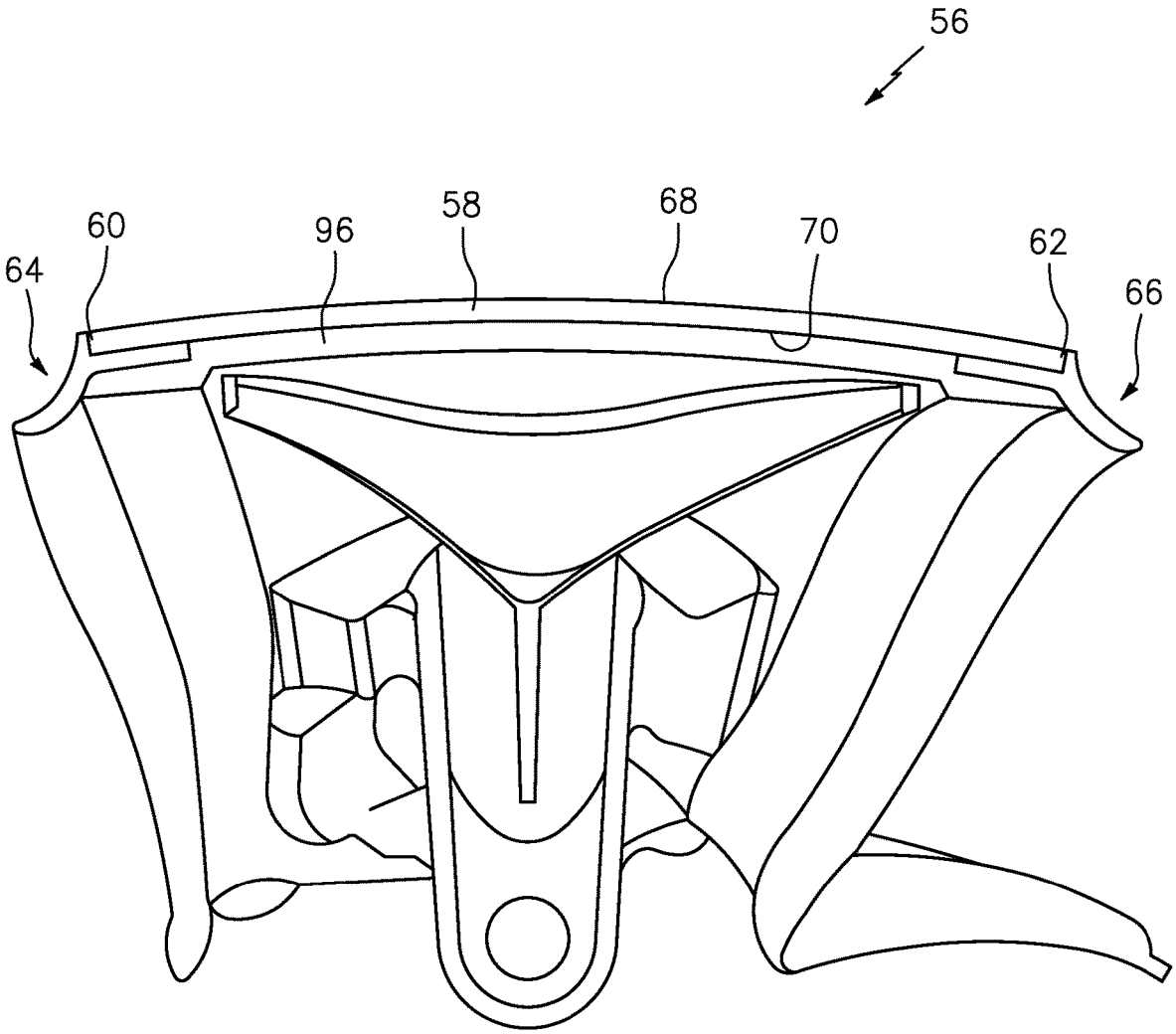
FIG. 3 illustrates a perspective view of the fan blade platform seal of FIG. 2 in accordance with one or more embodiments of the present disclosure.
Figure 4:
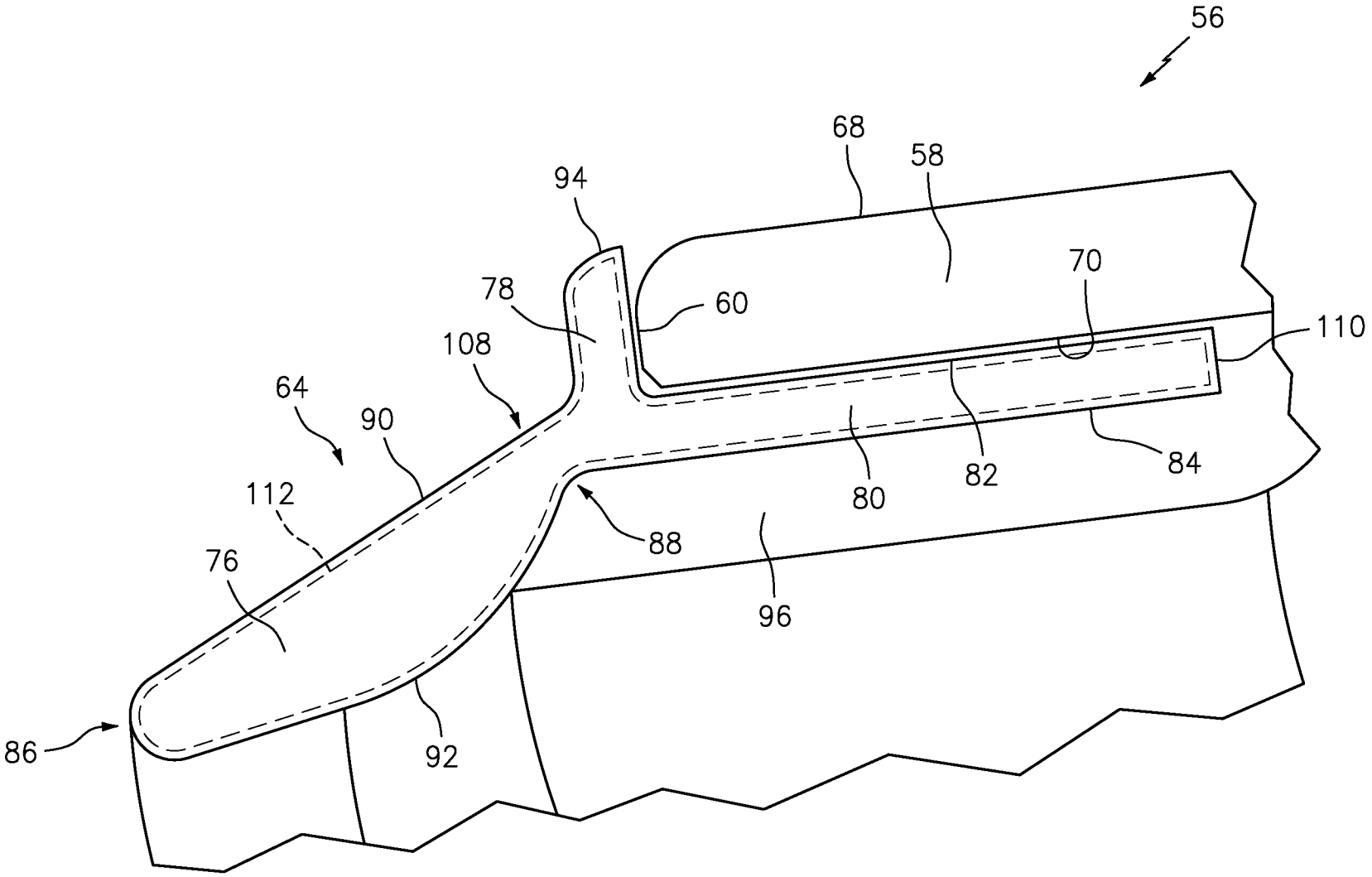
FIG. 4 illustrates a perspective view of a portion of the fan blade platform seal of FIG. 2 in accordance with one or more embodiments of the present disclosure.
Figure 5:
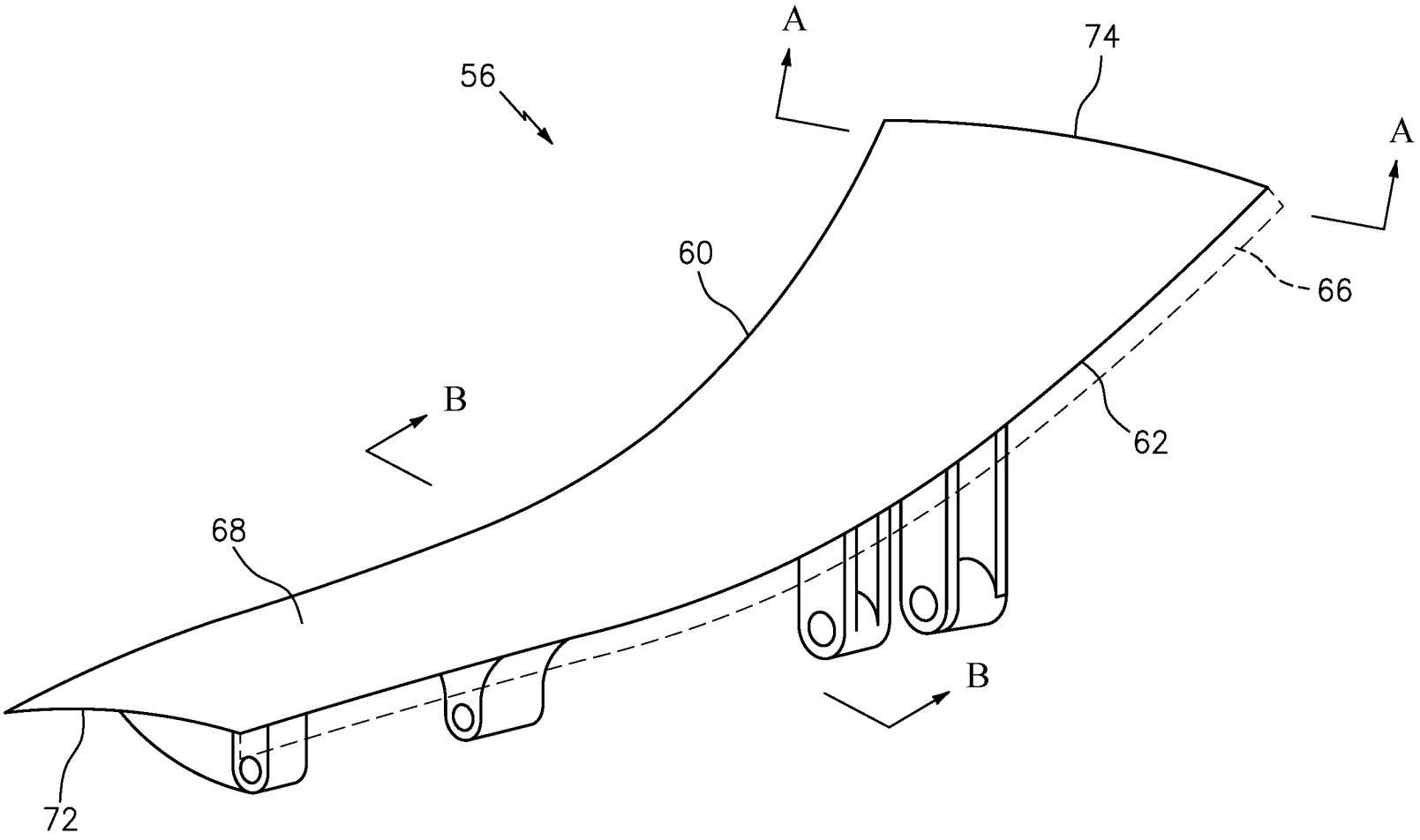
FIG. 5 illustrates another perspective view of the fan blade platform seal of FIG. 2 in accordance with one or more embodiments of the present disclosure.

Referring to FIGS. 3-5, the platform portion 58 further includes a flow path surface 68, which is a radially outer surface of the platform portion 58, and a bonding surface 70 opposite the flow path surface 68. Each of the flow path surface 68 and the bonding surface 70 extend between the first side 60 and the second side 62 of the platform portion 58. The flow path surface 68 and the bonding surface 70 further extend between a forward end 72 and an aft end 74 of the platform portion 58.

Each seal portion 64, 66 includes a seal body 108 including a sealing flap 76, a bumper rib 78, and a bonding segment 80. The sealing flap 76, bumper rib 78, and bonding segment 80 of the seal portions 64, 66 may extend along the respective sides 60, 62 of the platform portion for all or a portion of a distance between the forward end 72 and the aft end 74 of the platform portion. The bonding segment 80 may be mounted to the platform portion 58 by any suitable means such as, for example, an adhesive. The bonding segment 80 may include an outer surface 82 mounted to the bonding surface 70 of the platform portion 58 and an inner surface 84 opposite the outer surface 82. The outer surface 82 and the inner surface 84 may extend between the sealing flap 76 and a bonding segment end 110 of the bonding segment 80.

The sealing flap 76 may extend from the bonding segment 80 to a sealing end 86 and may converge with the bonding segment 80 at a crook 88 so that the sealing flap 76 is bendable with respect to the bonding segment 80. The sealing flap 76 may project away from the platform portion 58 so as to contact an adjacent fan blade of the plurality of fan blades 52. The sealing flap 76 may include a seal outer surface 90 extending from the bumper rib 78 to the sealing end 86 and a seal inner surface 92, opposite the seal outer surface 90, and extending from the inner surface 84 of the bonding segment 80.

The bumper rib 78 may extend from the seal portion 64, 66 in a substantially radial direction proximate the location of the seal portion 64, 66 where the sealing flap 76 converges with the bonding segment 80. Similar to the bonding portion 80, in various embodiments, the bumper rib 78 may be mounted to the respective side 60, 62 of the platform portion 58 by any suitable means such as, for example, an adhesive. The bumper rib 78 may be configured to provide a locating feature for mounting the seal portion 64, 66 to the platform portion 58. In various embodiments the bumper rib 78 may include an end 94 which may be substantially rounded or squared. In various embodiments, the end 94 of the bumper rib 78 may be flush with the flow path surface 68 of the platform portion 58. While FIG. 4 illustrates the first seal portion 64, it should be understood that the illustrated features of the first seal portion 64 may also be illustrative of the features of the second seal portion 66 as described above.

Referring to FIGS. 3-8, the fan blade platform seal 56 further includes a stiffening portion 96. As will be described in greater detail, the stiffening portion 96 may be mounted to one or more surfaces on the radially interior side of the fan blade platform seal 56. The stiffening portion 96 includes a stiffening layer 98 bonded to one or more of the platform portion 58 and the seal portions 64, 66 by a first bonding layer 100 on a first layer side 102 of the stiffening layer 98. In various embodiments, the stiffening portion 96 may further include a second bonding layer 104 bonded to all or a portion of a second layer side 106 of the stiffening layer 98 opposite the first layer side 102.

The stiffening layer 98 may be formed from any suitable material having sufficient stiffness and lightweight properties. In various embodiments, the stiffening layer 98 may be formed from or include a reinforcement fabric, for example, a fiberglass material such as a fiberglass cloth. In various other embodiments, the stiffening layer 98 may be formed from or include other reinforcement fabrics, for example, carbon fiber, aramid fiber, polyester fabric, para-aramid fiber (e.g., KEVLAR®), etc. The bonding layers 100, 104 may be formed from or may include an adhesive such as, for example, a resin epoxy, a silicon adhesive, or any other suitable bonding agent. One or both of the bonding layers 100, 104 may saturate, at least in part, the stiffening layer 98, thereby further stiffening the stiffening layer 98 once the bonding layer 100, 104 has cured. The material of the bonding layers 100, 104 may have a sufficiently low viscosity, in an uncured state, to saturate the stiffening layer 98, while providing suitable stiffness to the stiffening layer 98 and one or more portions of the fan blade platform seal 56, in a cured state. In various embodiments, a material of the bonding layer 100 may be different than a material of the bonding layer 104.

Figure 6:
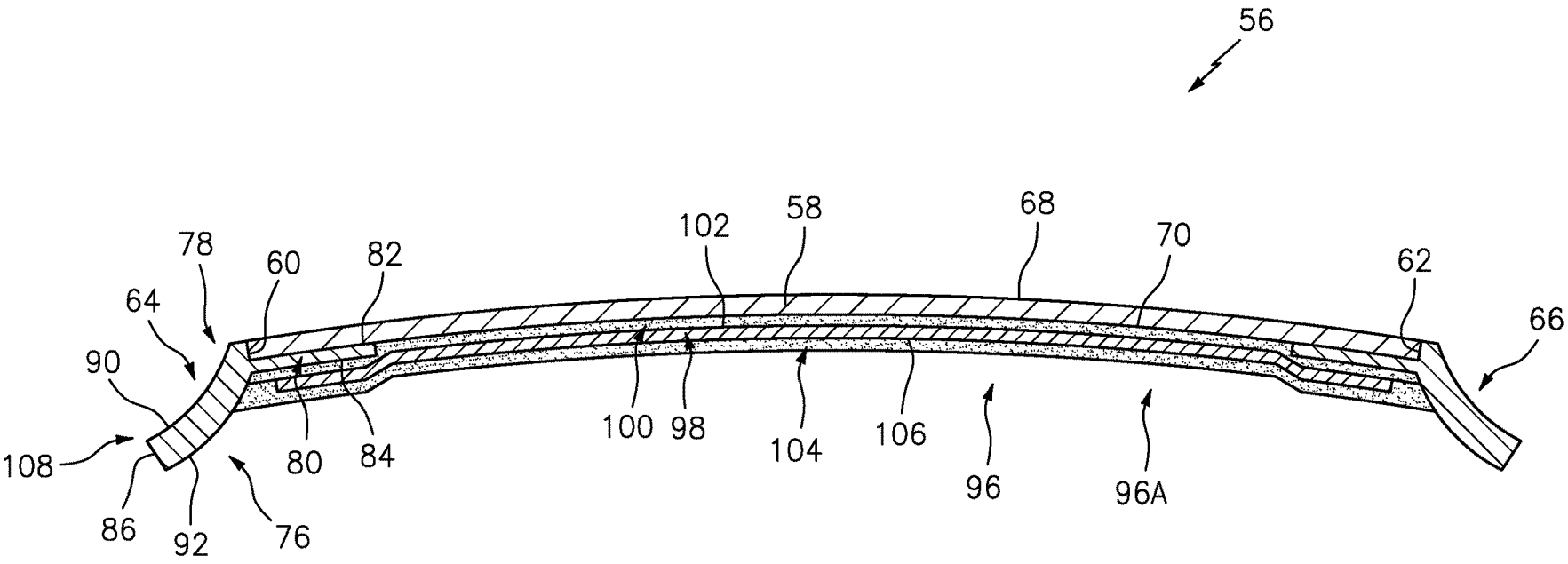
FIG. 6 illustrates a cross-sectional view of the fan blade platform seal of FIG. 5 taken along Line A-A in accordance with one or more embodiments of the present disclosure.

As shown in FIG. 6, in various embodiments, the stiffening portion 96 may be configured as a joining member 96A with the stiffening layer 98 bonded to one or more of the inner surface 84 of the bonding segments 80 of the seal portions 64, 66 as well as the bonding surface 70 of the platform portion 58 by the first bonding layer 100. For example, the stiffening layer 98 may extend across the fan blade platform seal 56 from the inner surface 84 of the bonding segment 80 of the first seal portion 64 to the inner surface 84 of the bonding segment 80 of the second seal portion 66 along the bonding surface 70 of the platform portion 58. In this configuration, the stiffening portion 96 of the fan blade platform seal 56 may provide additional stiffness and strength to the fan blade platform seal 56 while also supporting and/or retaining the seal portions 64, 66 to prevent disbonding of the seal portions 64, 66 from the platform portion 58. In various embodiments, the stiffening portion 96 may contact the seal inner surface 92 of the sealing flap 76 while in other various embodiments the stiffening portion 96 may not contact the seal inner surface 92 of the sealing flap 76. In various embodiments, the stiffening portion 96 may be disposed at the aft end 74 of the fan blade platform seal 56, for example, along the Line A-A shown in FIG. 5. However, in various other embodiments, the stiffening portion 96 may be disposed along other portions of the fan blade platform seal 56 between the forward end 72 and the aft end 74 or may extend an entire length of the fan blade platform seal 56 between the forward end 72 and the aft end 74. Further, in various embodiments, the stiffening portion 96 shown in FIG. 6 may be used in combination with one or more additional embodiments of the stiffening portion 96, which will be discussed in further detail.

Figure 7:
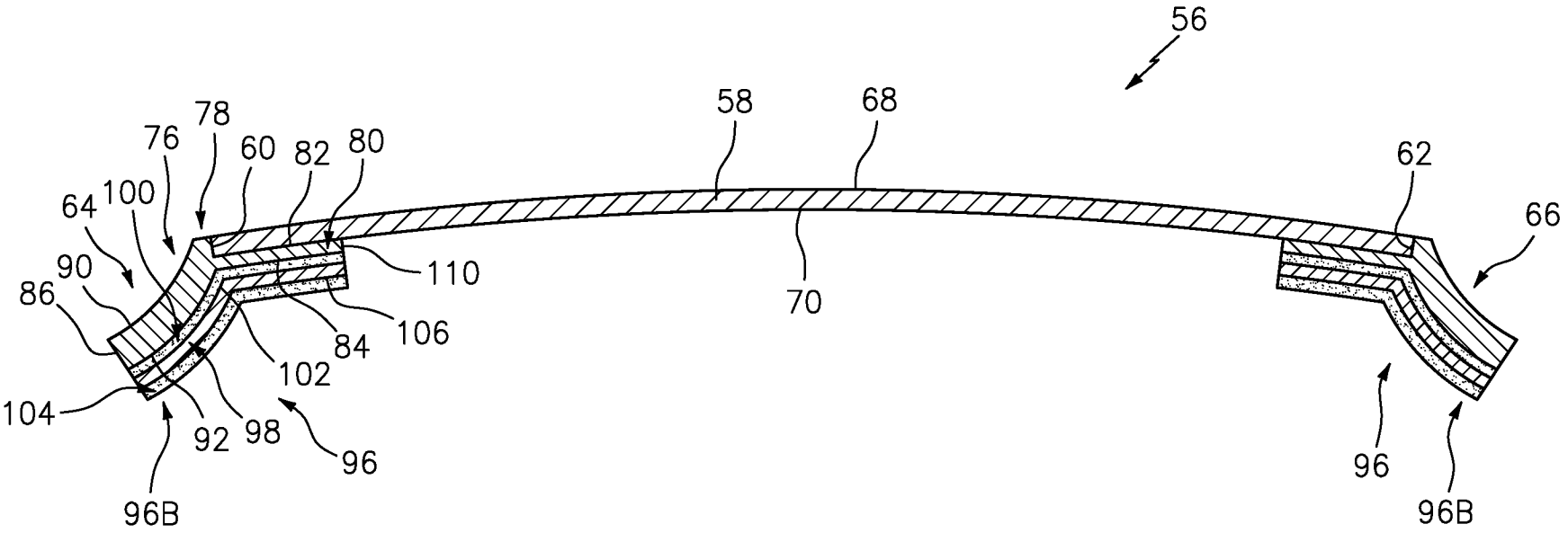
FIG. 7 illustrates a cross-sectional view of the fan blade platform seal of FIG. 5 taken along Line B-B in accordance with one or more embodiments of the present disclosure.

As shown in FIG. 7, in various embodiments, the stiffening portion 96 may be configured as a stiffening member 96B with the stiffening layer 98 bonded to the inner surface 84 of the bonding segment 80 as well as the seal inner surface 92 of the sealing flap 76 for one or both of the seal portions 64, 66. For example, the stiffening layer 98 may extend across the inner surface 84 and the seal inner surface 92 from the sealing end 86 to the bonding segment end 110. In this configuration, the stiffening portion 96 of the fan blade platform seal 56 may provide additional stiffness and strength to the sealing flap 76 so as to prevent or reduce the likelihood of an inversion of the sealing flap 76. In various embodiments, the stiffening portion 96 may be disposed in a central portion of the fan blade platform seal 56 between the forward end 72 and the aft end 74, for example, along the Line B-B shown in FIG. 5. However, in various other embodiments, the stiffening portion 96 may be disposed along other portions of the fan blade platform seal 56 between the forward end 72 and the aft end 74 or may extend an entire length of the fan blade platform seal 56 between the forward end 72 and the aft end 74. Further, as discussed above with respect to the stiffening portion 96 shown in FIG. 6, in various embodiments, the stiffening portion 96 shown in FIG. 7 may be used in combination with one or more additional embodiments of the stiffening portion 96.

Figure 8:
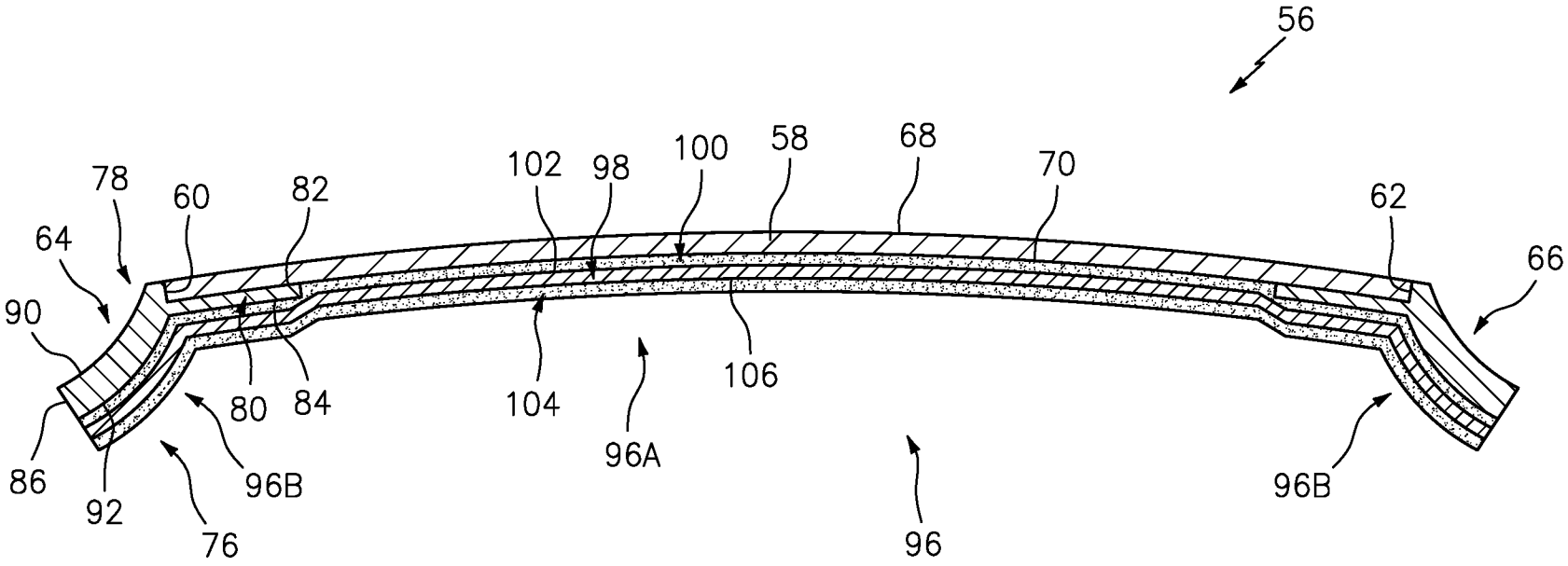
FIG. 8 illustrates a cross-sectional view of the fan blade platform seal of FIG. 5 taken along Lines A-A and/or B-B in accordance with one or more embodiments of the present disclosure.

As shown in FIG. 8, in various embodiments, the stiffening portion 96 may extend across a width of the fan blade platform seal 56. For example, in various embodiments, the stiffening portion 96 may extend from the sealing end 86 of the first seal portion 64 to the sealing end 86 of the second seal portion 66. The stiffening layer 98 may be bonded to one or more of the inner surfaces 84 and seal inner surfaces 92 of the seal portions 64, 66 as well as the bonding surface 70 of the platform portion 58 by the first bonding layer 100. In various embodiments, the stiffening portion 96 may extend continuously across the width of the fan blade platform seal 56, while in various other embodiments, the stiffening portion 96 may be segmented along the width of the fan blade platform seal 56. In various embodiments, the stiffening portion 96 may be disposed in a portion of the fan blade platform seal 56 between the forward end 72 and the aft end 74, for example, along the Lines A-A and/or B-B shown in FIG. 5. However, in various other embodiments, the stiffening portion 96 may be disposed along other portions of the fan blade platform seal 56 between the forward end 72 and the aft end 74 or may extend an entire length of the fan blade platform seal 56 between the forward end 72 and the aft end 74. Further, as discussed above with respect to the stiffening portion 96 shown in FIGS. 6 and 7, in various embodiments, the stiffening portion 96 shown in FIG. 8 may be used in combination with one or more additional embodiments of the stiffening portion 96.

In various embodiments, one or both of the seal portions 64, 66 may include a fabric layer 112 covering at least a portion of the seal body 108, as exemplified by the dashed lines in FIG. 4. The fabric layer 112 may be formed from, but is not limited to, a polyester weave or an aramid. The fabric layer 112 may aid in protecting the seal portions 64, 66 from wear and may facilitate improved bonding of the seal portions 64, 66 to one or both of the platform portion 58 and the stiffening portion 96.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Accordingly, the present disclosure is not to be restricted except in light of the attached claims and their equivalents.

What is claimed is:

1. A fan blade platform seal comprising:

a platform portion comprising a first side and a second side opposite the first side, the platform portion further comprising a flow path surface extending between the first side and the second side and a bonding surface opposite the flow path surface;

a first seal portion comprising a first bonding segment comprising a first outer surface, mounted to the platform portion on the first side of the platform portion, and a first inner surface opposite the first outer surface;

a second seal portion comprising a second bonding segment comprising a second outer surface, mounted to the platform portion on the second side of the platform portion, and a second inner surface opposite the second outer surface; and a stiffening portion mounted to the first inner surface, the stiffening portion comprising a first bonding layer bonded to the first inner surface and a stiffening layer bonded to the first bonding layer on a first layer side of the stiffening layer;

wherein the stiffening portion is additionally mounted to the bonding surface of the platform portion and to the second inner surface.

2. The fan blade platform seal of claim 1, wherein the first seal portion further comprises a first sealing flap extending from the first bonding segment to a sealing end, the first sealing flap projecting away from the platform portion, the first sealing flap comprising a first seal inner surface extending from the first inner surface of the first bonding segment.

3. The fan blade platform seal of claim 2, wherein the stiffening portion is additionally mounted to the first seal inner surface.

4. The fan blade platform seal of claim 3, wherein the stiffening portion is additionally mounted to the bonding surface of the platform portion.

5. The fan blade platform seal of claim 1, wherein the stiffening portion further comprises a second bonding layer bonded to a second layer side of the stiffening layer opposite the first layer side.

6. The fan blade platform seal of claim 1, wherein the stiffening layer comprises a reinforcement fabric.

7. The fan blade platform seal of claim 1, wherein the first seal portion comprises a seal body and a fabric layer covering at least a portion of the seal body.

8. The fan blade platform seal of claim 1, wherein the platform portion further comprises a forward end and an aft end and wherein each of the first seal portion and the second seal portion extend from the forward end to the aft end.

9. The fan blade platform seal of claim 8, wherein the stiffening layer extends from the forward end to the aft end.

10. A method for forming a fan blade platform seal, the method comprising:

providing a platform portion comprising a first side and a second side opposite the first side, the platform portion further comprising a flow path surface extending between the first side and the second side and a bonding surface opposite the flow path surface;

mounting a first seal portion to the first side of the platform portion, the first seal portion comprising a first bonding segment comprising a first inner surface opposite the platform portion;

applying a stiffening portion to the first inner surface by bonding a stiffening layer to the first inner surface with a bonding layer; and applying the stiffening portion to the bonding surface of the platform portion by bonding the stiffening layer to the bonding surface with the bonding layer.

11. The method of claim 10, wherein the first seal portion further comprises a first sealing flap extending from the first bonding segment to a sealing end, the method further comprising applying the stiffening portion to a first seal inner surface of the first sealing flap by bonding the stiffening layer to the first seal inner surface with the bonding layer.

12. The method of claim 10, wherein the bonding layer comprises an adhesive.

13. The method of claim 10, further comprising:

mounting a second seal portion to the second side of the platform portion, the second seal portion comprising a second bonding segment comprising a second inner surface opposite the platform portion; and applying the stiffening portion to the second inner surface by bonding the stiffening layer to the second inner surface with the first bonding layer;

wherein the stiffening portion extends from the first seal portion to the second seal portion.

14. A gas turbine engine comprising:

a fan configured to rotate about a longitudinal centerline of the gas turbine engine, the fan comprising a plurality of fan blades extending radially outward from and circumferentially spaced about a fan rotor; and a fan blade platform seal circumferentially disposed between circumferentially adjacent fan blades of the plurality of fan blades, the fan blade platform seal comprising:

a platform portion comprising a first side and a second side opposite the first side, the platform portion further comprising a flow path surface extending between the first side and the second side and a bonding surface opposite the flow path surface;

a first seal portion comprising a first bonding segment comprising a first outer surface, mounted to the bonding surface on the first side of the platform portion, and a first inner surface opposite the first outer surface;

a second seal portion comprising a second bonding segment comprising a second outer surface, mounted to the bonding surface on the second side of the platform portion, and a second inner surface opposite the second outer surface;

a stiffening portion mounted to the first inner surface and the second inner surface, the stiffening portion comprising a first bonding layer bonded to the first inner surface and the second inner surface, a stiffening layer bonded to the first bonding layer on a first layer side of the stiffening layer, and a second bonding layer bonded to a second layer side of the stiffening layer opposite the first layer side.

15. The gas turbine engine of claim 14, wherein the first seal portion further comprises a first sealing flap extending from the first bonding segment to a first sealing end and the second seal portion further comprises a second sealing flap extending from the second bonding segment to a second sealing end; and wherein the stiffening portion is additionally mounted to the first sealing flap and the second sealing flap.

16. The gas turbine engine of claim 14, wherein the stiffening portion is additionally mounted to the bonding surface of the platform portion.

* * * * *